US005257018A

United States Patent [19]

Kakizaki et al.

[11] Patent Number: 5,257,018

[45] Date of Patent: Oct. 26, 1993

[54] DISPLAY DEVICE

[75] Inventors: Takehiro Kakizaki; Minoru Ohzeki, both of Kanagawa, Japan

[73] Assignee: Sony Corporation, Tokyo, Japan

[21] Appl. No.: 473,405

[22] Filed: Feb. 1, 1990

[30] Foreign Application Priority Data

Feb. 2, 1989 [JP] Japan ..... 1-24511

[51] Int. Cl.[5] ..... G09G 3/20; G09G 1/28

[52] U.S. Cl. ..... 345/30; 313/478; 358/59; 345/32

[58] Field of Search ..... 340/720, 703, 752, 757, 340/815.1, 815.12; 313/478, 479, 495, 503, 496; 358/252, 253, 59

[56] References Cited

U.S. PATENT DOCUMENTS

| | | | |
|---|---|---|---|
| 3,582,189 | 6/1971 | Moritz et al. | 358/252 |
| 3,638,060 | 1/1972 | Wacher | 358/252 |
| 3,909,524 | 9/1975 | Ohkoshi et al. | 313/478 |
| 4,204,222 | 5/1980 | Zacharie | 358/59 |
| 4,368,485 | 1/1983 | Midland | 340/720 |
| 4,755,716 | 7/1988 | Hayafune et al. | 313/478 |
| 4,990,824 | 2/1991 | Vriens | 358/253 |

FOREIGN PATENT DOCUMENTS

| | | |
|---|---|---|
| 0145201 | 6/1985 | European Pat. Off. . |
| 0197596 | 10/1986 | European Pat. Off. . |
| 2178226 | 6/1986 | United Kingdom . |

*Primary Examiner*—Ulysses Weldon
*Assistant Examiner*—M. Fatahi-Yar
*Attorney, Agent, or Firm*—Hill, Steadman & Simpson

[57] ABSTRACT

A jumbo-size picture display device arranged such that a number of red, green and blue fluorescent trios are formed in an X-Y matrix form. A shading material for controlling the color temperature is formed above predetermined red, green and blue fluorescent segments, whereby the color temperature can be corrected in a simple manner. The quality of the jumbo-size picture display device is improved and the manufacturing costs are reduced.

19 Claims, 8 Drawing Sheets

DISPLAY DEVICE

BACKGROUND OF THE INVENTION

1. Field of the Invention

The present invention relates generally to jumbo-size picture display devices and, more particularly, is directed to a jumbo-size picture display device in which a number of trios, each being formed of red, green and blue fluorescent segments, are arranged in an X-Y matrix-fashion.

2. Description of Prior Art

A jumbo-size picture display device for displaying a large color picture, for example, a jumbo-size color picture is represented, for example, in FIG. 1.

As shown in FIG. 1, for example, red, green and blue fluorescent segments R, G and B are formed as a set, i.e., trio. A fluorescent display cell 41 is formed in which 16 trios of fluorescent segments R, G and B are arranged on its fluorescent screen in, for example, 2 rows and 8 columns. A plurality of fluorescent display cells 41 are arranged in each of the vertical direction Y and in the horizontal direction X, thereby forming a jumbo-size picture display device 40. In this jumbo-size picture display device 40, the respective fluorescent segments are driven in response to display data to display a color visual image of jumbo-size.

Each of the fluorescent display cells 41 forming the jumbo-size picture display device 40 is constructed as follows:

The fluorescent display cell 41, as shown in FIG. 2, includes a front panel 42, a rear panel 43 and side plates 44 which are bonded by frit glass 45 to form a flat glass housing 46. Within this flat glass housing 46, an electron beam control mechanism is provided in an opposing relation to a fluorescent screen 47 that is formed on the inner surface of the front panel 42 by aligning thereon red, green and blue fluorescent segments R, G and B. This electron beam control mechanism, denoted by reference numeral 48 in FIG. 2, includes at least a cathode and first and second grids to urge an electron beam to impinge upon the red, green and blue segment trios R, G and B. Lead wires 49, which apply a low voltage to the electron beam control mechanism 48, are led-out to the outside of the housing 46 via the frit glass 45 between the rear panel 43 and the side plate 44. A high voltage (anode voltage) is applied to the fluorescent screen 47.

In the jumbo-size picture display device 40 in which a number of fluorescent display cells 41, each having the fluorescent screen with the red, green and blue fluorescent segments R, G and B, are arranged in the X-Y matrix form, at least irregular color temperature between the fluorescent display cells 41 must be reduced in order to obtain a jumbo-size picture of excellent image quality and of high definition.

More specifically, in order to measure a color temperature, a white color is displayed in each of the fluorescent display cells 41. As shown, in FIG. 3, certain of the fluorescent display cells 41*a* and 41*b* although they display the same color white, the same color white appears pale and yellowish due to the increase and decrease of the color temperature, thus giving rise to irregularities of the displayed white colors. This irregularity of the displayed white color due to irregularity of the color temperature between the fluorescent display cells considerably degrades the quality of the reproduced picture.

Further, the color temperature with respect to a white color is standardized at 9300°±2000° Kl, and a fluorescent display cell which has a white color temperature which is outside the standardization temperature must be considered a failed or unabled fluorescent display cell.

Furthermore, in the prior-art jumbo-size picture display device 40, in order to reduce irregularities of the color temperature between the fluorescent display cells, the accuracy of the assembly parts of the electrodes and the accuracy in the assembly-process must be increased. Further, irregularities in the manufacturing-process of the fluorescent screen (film thickness, metal back layer, et cetera) must be reduced.

OBJECTS AND SUMMARY OF THE INVENTION

Therefore, it is an object of the present invention to provide an improved jumbo-size picture display device which avoids the aforementioned defects encountered with the prior art.

More specifically, it is an object of the present invention to provide an improved jumbo-size picture display device in which the color temperature can be accurately and easily controlled.

It is another object of the present invention to provide an improved jumbo-size picture display device which has higher quality than prior art devices.

It is a further object of the present invention to provide an improved jumbo-size picture display device in which the quality of the reproduced picture is improved.

It is still another object of the present invention to provide an improved jumbo-size picture display device which can be cheaply manufactured.

It is an additional object of the present invention to provide an jumbo-size picture display device in which the yield of the display cells is increased, and which increases production yield of jumbo-size picture display devices.

In accordance with an aspect of this invention, a display device is comprised of a plurality of picture cells in each of which are mounted a plurality of fluorescent trios of red, green and blue fluorescent segments and which are aligned on an inner surface of a front panel at a predetermined alignment pitch and wherein a shading material for controlling the color temperature is formed on an outer surface of the front panel at a position corresponding to a predetermined fluorescent segment so that, when all of the fluorescent trios are driven, the color temperatures of the whole display surface are uniform.

The above, and other objects, features and advantages of the present invention, will become apparent in the following detailed description of preferred embodiments to be read in conjunction with the accompanying drawings, in which like reference numerals are used to identify the same or similar parts in the several views.

DETAILED DESCRIPTION OF PREFERRED EMBODIMENTS

Figure 1:
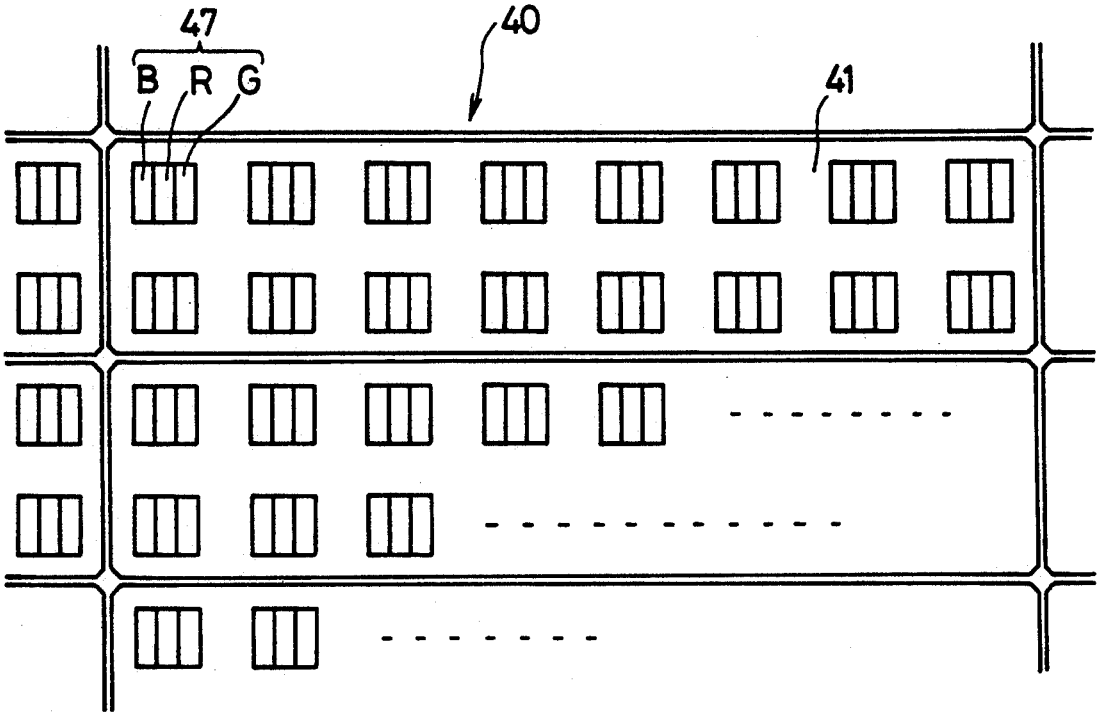
FIG. 1 (PRIOR ART)
FIG. 1 is a fragmentary, front view illustrating an example of a jumbo-size picture display device according to the prior art.
Figure 2:
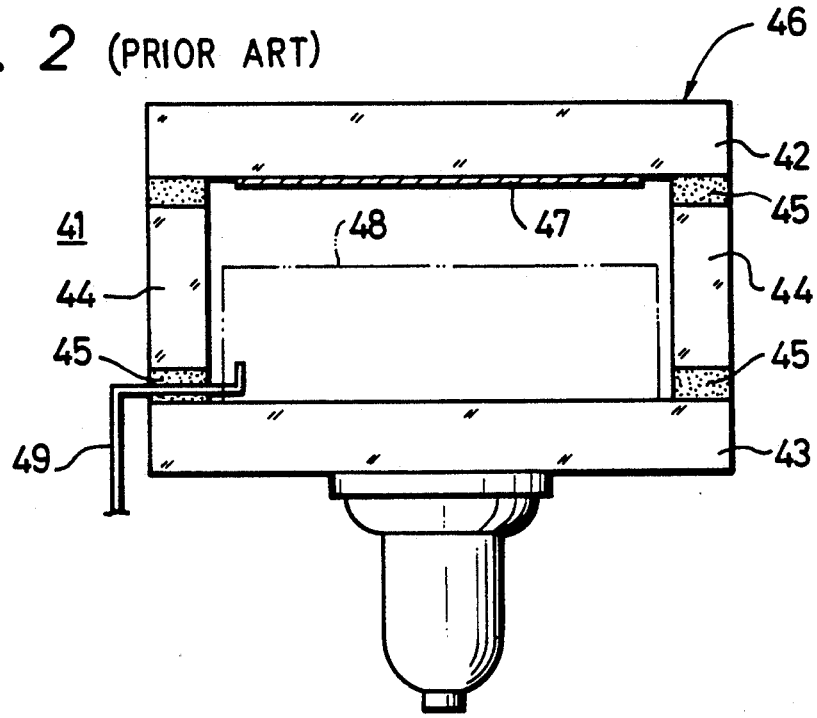
FIG. 2 (PRIOR ART)
FIG. 2 is a diagrammatic view of a section showing an example of a fluorescent display cell used in the jumbo-size picture display device of FIG. 1.
Figure 3:
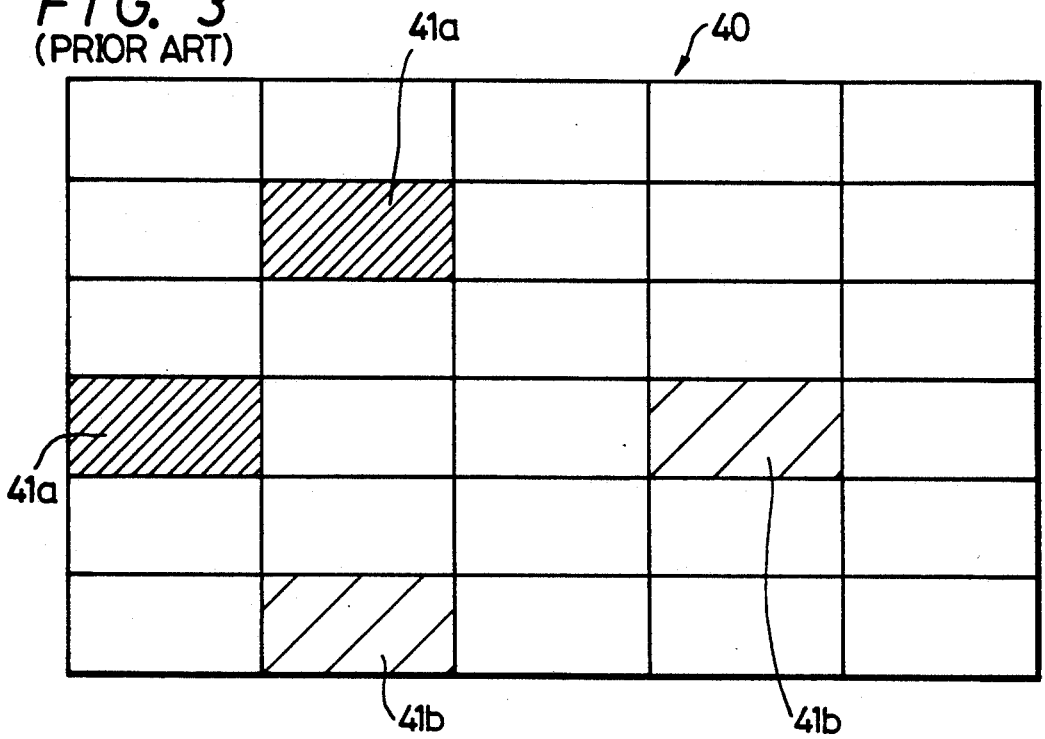
FIG. 3 (PRIOR ART)
FIG. 3 is a front view of a prior-art jumbo-size picture display device, and to which reference will be made for explaining the operation of the prior-art jumbo-size picture display device.
Figure 4:
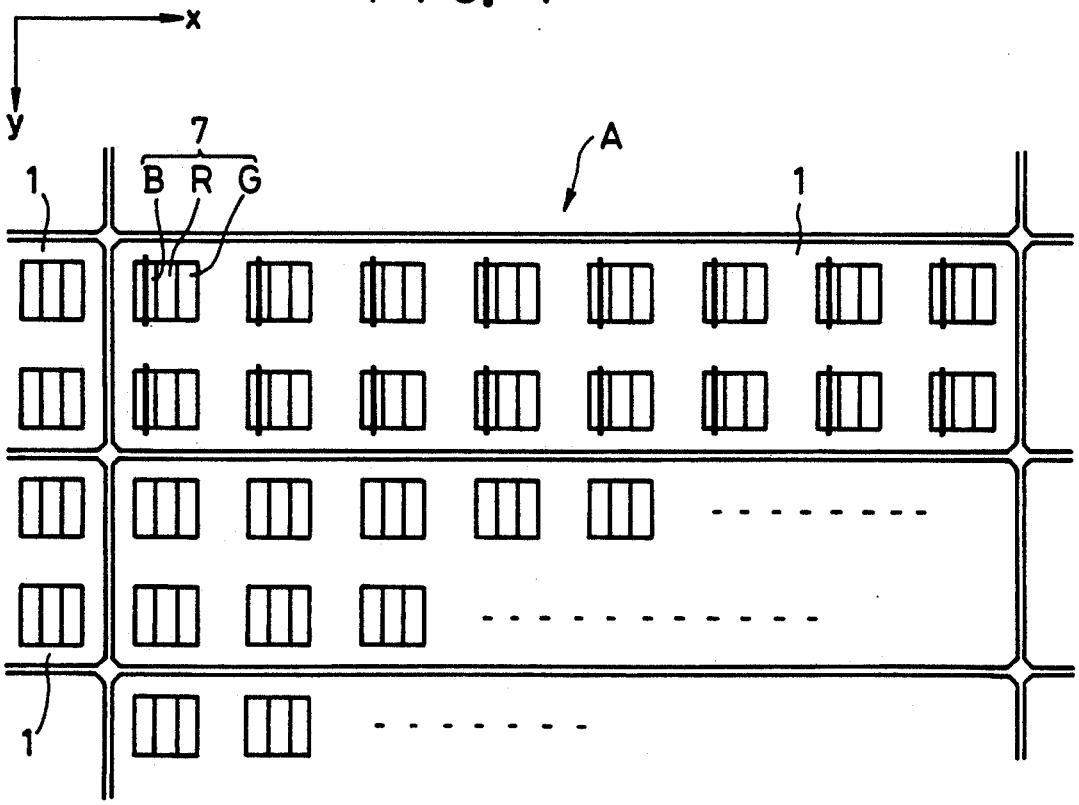
FIG. 4 is a fragmentary, front view of a jumbo-size picture display device according to a first embodiment of the present invention.

Referring to the drawings in detail, and initially to FIG. 4, a jumbo-size picture display device of this embodiment is formed by aligning a number of fluorescent display cells 1 in the horizontal direction X and the vertical direction Y in an X-Y matrix form. As earlier noted, each of the fluorescent display cells 1 is provided with a fluorescent screen 7 in which 16 fluorescent trios, each of which are formed of red, green and blue fluorescent segments R, G and B are arranged, for example, in 2 rows and 8 columns.

The arrangement of the fluorescent display cell I will be described more fully with reference to FIG. 5.

Figure 5:
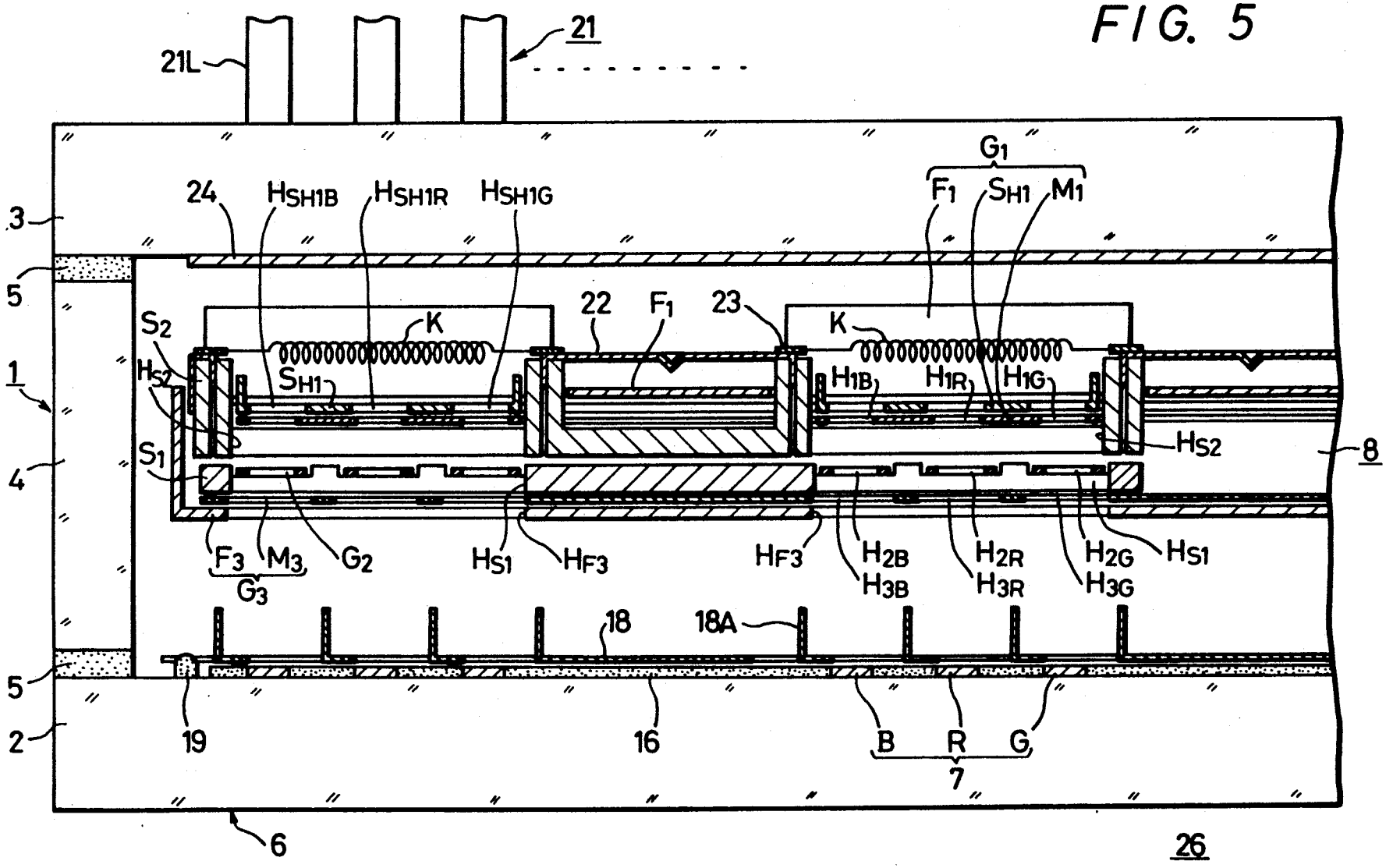
FIG. 5 is a fragmentary, diagrammatic view of a section showing an arrangement of a fluorescent display cell used in the present invention.

As shown in FIG. 5, side plates 4 formed of glass walls form four side walls are provided between a rectangular front glass panel 2 and a rectangular rear glass panel 3, which are joined by frit glasses 5, thereby forming a flat glass housing 6. The flat glass housing 6 might be formed by sealing glass plates which contain an ion element which has a large ionization tendency and with the frit glass 5 which contains a metal element which has a small ionization tendency. In other words, the front and rear panels 2 and 3 and the side plates 4 might be each formed of so-called soda glass plates which are inexpensive and which can be used for various purposes.

On the inner surface of the front panel 2, a plurality of sets of fluorescent trios, each made of, for example, of red, green and blue fluorescent segments R, G and B, are aligned in, for example, 2 rows and 8 columns. A light absorbing layer 16 such as a carbon coating layer or the like is deposited between the adjacent fluorescent segments R, G and B, and a metal back layer (not shown) such as an aluminum-deposited layer or the like is formed on the whole surface thereof, thereby forming the fluorescent screen 7.

In the front surface of the fluorescent screen 7, a separate electrode 18 is mounted which has a plurality of partition walls 18A. The partition walls 18A are used to partition front spaces of the fluorescent segments R, G and B, thereby preventing mutual interference of the electron beams onto the respective fluorescent segments R, G and B. The separator electrode 18 is supported to the front panel 2 by frit-fixing the electrode 18 with, for example, glass frit 19 to the front panel 2.

The electron beam control mechanism 8 is mounted so as to be opposed to the fluorescent screen 7. This electron beam control mechanism 8 is formed by sequentially aligning a cathode K and first, second and third grids $G_1$, $G_2$ and $G_3$, each of which have a configuration of a flat plate and mounted in an opposing relationship parallel to the fluorescent screen 7, in order of grid $G_1$, $G_2$ and $G_3$.

The third grid $G_3$ is formed by laminating a third grid frame $F_3$ which is formed, for example, of a metal plate and a third grid body $M_3$ made of a thin metal plate. The third grid frame $F_3$ has formed therethrough an aperture $H_{F3}$ which is common to the fluorescent trio of red, green and blue fluorescent segments R, G and B on the fluorescent screen 7. The third grid body $M_3$ has formed at positions thereof corresponding to each of the apertures $H_{H3}$ of the third grid frame $F_3$ mesh-shaped electron beam apertures $H_{3R}$, $H_{3G}$ and $H_{3B}$ in an opposing relation to the respective fluorescent segments R, G and B by a photolithography-process or the like. The third grid body $M_3$ is laminated on the third grid frame $F_3$ such that the apertures $H_{3R}$, $H_{3G}$ and $H_{3B}$ of the former coincide with the corresponding aperture $H_{F3}$ of the latter. Further, a first insulating spacer $S_1$ made of material such as ceramics or the like is laminated on the third grid body $M_3$ such that it is common to four fluorescent trios arranged in 2 rows and 2 columns. The first insulating spacer $S_1$ has formed therethrough apertures $H_{S1}$ which correspond to the apertures $H_{F3}$ of the third grid frame $F_3$.

The second grid $G_2$ is mounted in an opposing relation to the third grid $G_3$ by the first insulating spacer $S_1$. In the second grid $G_2$, common band-shaped electrode portions are aligned in parallel to the common direction (in the direction vertical to the sheet of FIG. 5) of the respective mesh-shaped electron beam apertures $H_{3R}$, $H_{3G}$ and $H_{3B}$ of the third grid body $M_3$. Through the respective band-shaped electrode portions, there are formed two mesh-shaped electron beam apertures $H_{2R}$, $H_{2G}$ and $H_{2B}$ in association with the set of apertures $H_{3R}$, $H_{3G}$ and $H_{3B}$ which are aligned on the common column of the third grid frame $F_3$ in the direction vertical to the sheet of drawing of FIG. 5 by a photolithography-process or the like. In the electron beam apertures $H_{2R}$, $H_{2G}$ and $H_{2B}$, the mesh size, for example, of the electron beam aperture $H_{2B}$ is reduced almost to the lower optical transmissivity of the electron beam per unit area, whereas the mesh size of the electron beam aperture $H_{2R}$ is increased and the mesh size of the electron beam aperture $H_{2G}$ is increased substantially, thereby increasing the optical transmissivity of the electron beam. The respective ends of each band-shaped electrode portion form a lead wire 21L. Before the assembly-process, the respective lead wires 21L are coupled together to form a lead frame.

The first grid $G_1$ is opposed to the second grid $G_2$ by way of a second insulating spacer $S_2$ made of a similar insulating material such as ceramics and so on. The second insulating spacer $S_2$ also serves as a cathode supporting member. In the second insulating spacer $S_2$, similarly to the first insulating spacer $S_1$, there are formed apertures $H_{S2}$ which are commonly provided for four fluorescent trios which are arranged in 2 rows and 2 columns and which correspond to the apertures $h_{F3}$ of the third grid frame $F_3$ of the third grid $G_3$. The first grid $G_1$ is formed by laminating a first grid body $M_1$, a shield plate $S_{H1}$ and a first grid frame $F_1$, in that order. The first grid body $M_1$ has formed therethrough similar mesh-shaped electron beam apertures $H_{1R}$, $H_{1G}$ and $H_{1B}$ which correspond to the respective mesh-shaped electron beam apertures $H_{3R}$, $H_{3G}$, $H_{3B}$ and $H_{2R}$, $H_{2G}$, $H_{2B}$ of the third and second grids $G_3$ and $G_2$ by, for example, a photolithography-process. The shield plate $S_{H1}$ of the first grid $G_1$ is formed, for example, by a punching-process and a bending-process of a metal plate for four trios, with each set being formed of mesh-shaped apertures $H_{1R}$, $H_{1G}$ and $H_{1B}$, i.e., four trios arranged in 2 rows and 2 columns. Each shield plate $S_{H1}$ has formed at positions thereof corresponding to the mesh-shaped apertures $H_{1R}$, $H_{1G}$ and $H_{1B}$ of the first grid body $M_1$ apertures $H_{SH1R}$, $H_{SH1G}$ and $H_{SH1B}$. The first grid frame $F_1$ of the first grid $G_1$ can be formed by a punching-process and a bending-process of a metal plate similarly to the plurality of shield plates $S_{H1}$.

The cathode K is formed by depositing a cathode material on a spiral-shaped heater which extends in a straight-line fashion by using a spray-process or the like. The respective ends of the cathode K are directly welded to a metal piece member 22 or are welded in advance to the metal piece member 22 by way of a cathode supporting member 23, for example.

The electron beam control mechanism 8 in which the cathode K and the first to third grids $G_1$ to $G_3$ are formed as one body is provided within the flat glass housing 6 such that respective leads 21 such as the lead wire 21L of the second grid $G_2$, the lead wires of the first and third grids $G_1$ and $G_3$ and the cathode K and so on are led to the outside of the housing 6 via the frit glass 5 between the rear panel 3 and the side plate 4.

A rear electrode 24 is formed on the inner surface of the rear panel 3, for example, by a carbon-coating-process or the like. A metal resilient member attached to, for example, the first grid $G_1$ of the electron beam control mechanism 8 is in resilient contact with the rear electrode 24 so as to thereby electrically connect the rear electrode 24 and the first grid $G_1$.

In the aforementioned arrangement, a voltage, for example, of 5 kV is applied to the fluorescent screen 7 and the separator electrode 18. A voltage of, for example, 10 V is applied to the first grid $G_1$ and the rear electrode 24, and a voltage of 0 V is applied to the third grid $G_3$ via the respective lead wires. To the second grid $G_2$ there is selectively applied a voltage of 15 V in the on-state and a voltage of −2 V in the off-state through the lead wire 21L. When the ON and OFF voltages are selectively supplied to the band-shaped electrode portion of the second grid $G_2$ and when the voltages which are applied to the cathode K are properly selected, electron beams which travel to the respective fluorescent segments R, G and B are modulated so as to drive the respective fluorescent segments R, G and B, for example, in a line-sequential manner to thereby emit respectively colored light.

Figure 6A:
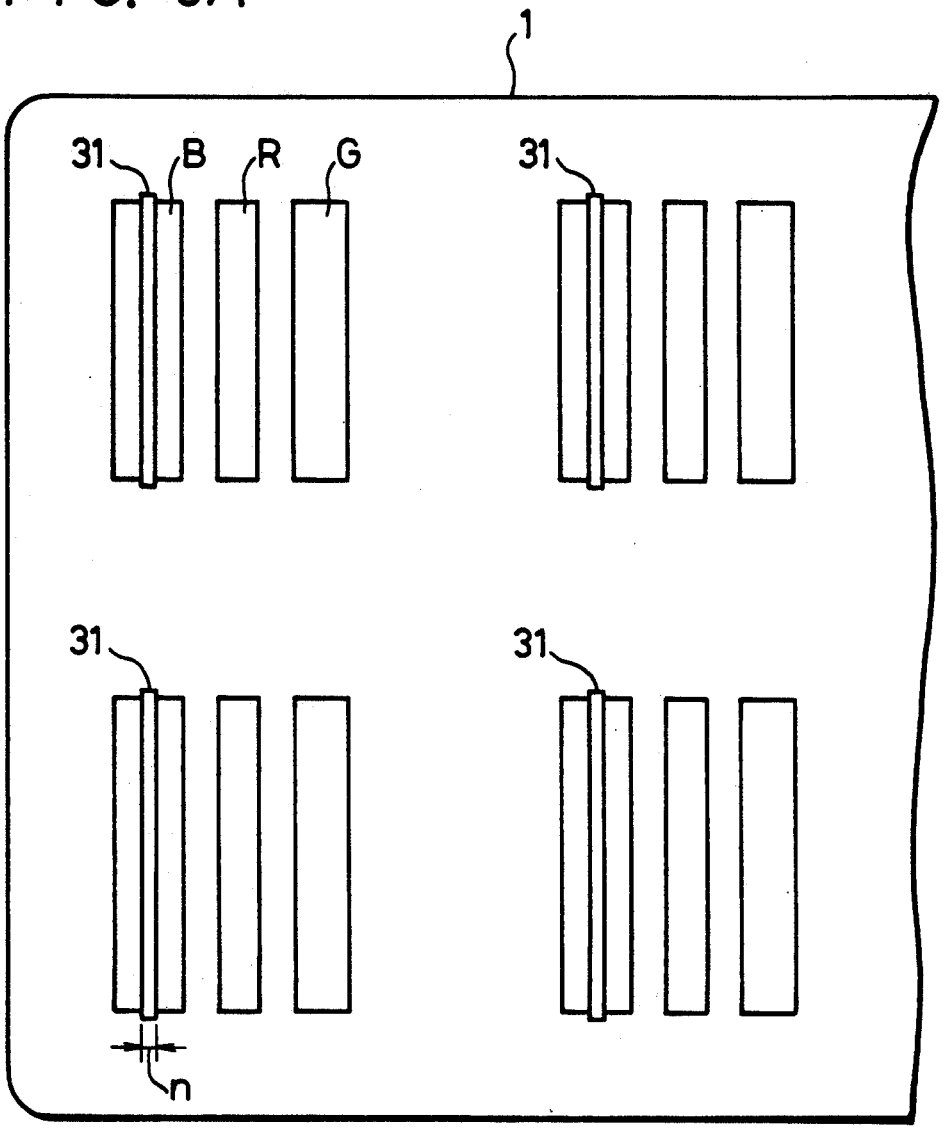
FIG. 6A is a fragmentary, front view of a fluorescent display cell used in the present invention.
Figure 6B:
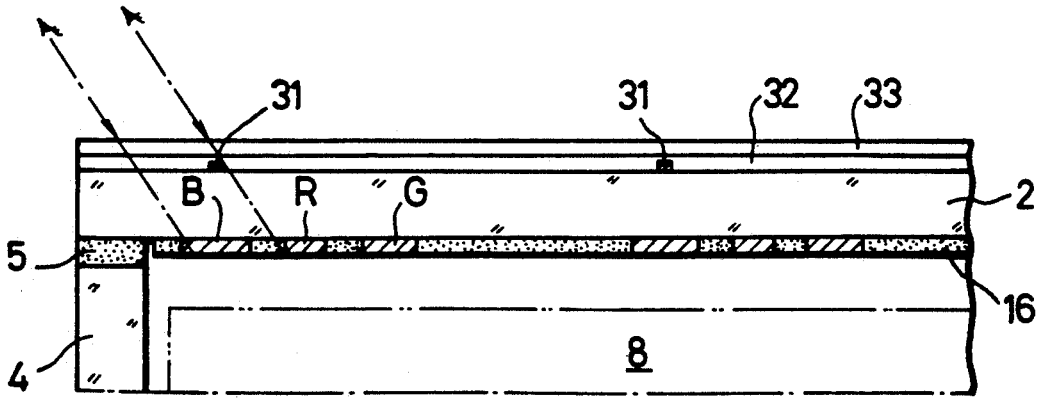
FIG. 6B is a fragmentary, diagrammatic view of a section of FIG. 6A.

A white color is displayed by the thus arranged fluorescent display cell and the color temperature is measured. When the color temperature is too high (higher than 9300°±2000° K.), or when the white color looks pale, as shown in FIGS. 6A and 6B, a light shielding or shading material 31 which has a width narrower than the blue fluorescent segment B is formed on the outer surface of the front panel 2 at a position corresponding to the center portion of the blue fluorescent segment B by a printing-process. While in the illustrated example the shading material 31 is formed on 16 blue fluorescent segments B by the printing-process, the number of blue fluorescent segments B to which the shading material 31 is provided is not limited to 16 and may be less than 16 so long as the color temperature falls within a standardized range of color temperature.

Conversely, when the color temperature is too low (lower than 9300°−2000° K.), or when the white color becomes yellowish, the shading material 31 which has a width narrower than that of the green or red fluorescent segment G or R is formed on the outer surface of the front panel 2 at the position corresponding to the central portion of the green fluorescent segment G or on the central portion of the red fluorescent segment R by a printing-process.

The shading material 31 may be black material such as carbon or white material such as titanium oxide. For example, when the shading material 31 which has an area which corresponds to 10% of the light-emission area of the blue fluorescent segment B is formed above the blue fluorescent segment B by a printing-process, if the color of the shading material 31 is black, the color temperature can be lowered by 3000° K., whereas if the color of the shading material 31 is white, the color temperature can be lowered by 2300° K. The amount which the color temperature is corrected can be freely changed depending on the area of the shading material 31, thus making it possible to adjust the color temperature with high accuracy.

Considering a visual field angle when the picture screen is seen especially from the lateral direction, the shading material 31 must be formed to have a stripe-shaped configuration with a width n so that it does not affect the neighboring fluorescent segments when they are seen from the lateral direction.

Thereafter, an antistatic film 32 and a dazzling-preventing film 33 are deposited on the whole outer surface of the front panel 2 including the shading material 31, thus completing the fluorescent display cell 1.

As described above, a number of fluorescent display cells 1 are aligned in the horizontal direction and in the vertical direction y, thus forming the jumbo-size display cell or device A shown in FIG. 4.

As described above, according to this embodiment, the stripe-shaped shading material 31 which has an area smaller than the light-emission area of one fluorescent segment is formed above the predetermined fluorescent segment (the blue fluorescent segment B if the color temperature is high, whereas the red or green fluorescent segment R or G if the color temperature is low) is formed by the printing-process so as to correct the color temperature of the fluorescent display cell 1 so that, even when the jumbo-size display device A is formed by arranging a number of fluorescent display cells 1, the color temperature of the whole display device is prevented from being scattered. Thus, the quality of the jumbo-size picture display device A can be improved and the quality of the reproduced picture can be improved. Further, the color temperature of the fluorescent display cell can be easily corrected so that, even when the color temperature lies outside of the standardized range of color temperature, the fluorescent display cell 1 can be utilized as a useable fluorescent display cell by correcting for its extraordinary color temperature. Therefore, the yield of the fluorescent display cells 1 can be increased, and the production of jumbo-size picture display devices A can be increased and the manufacturing costs of jumbo-size picture display devices A can be decreased. Furthermore, since the shading material 31 is formed as a narrow stripe-shape, such shading material 31 does not substantially affect the visual field angle of the display cell.

Other embodiments of the invention in which a semitransparent film 34 which has a low optical transmissivity is used to correct the color temperature of the fluorescent display cell 1 will be described with reference to FIGS. 7 to FIG. 10, in which the same parts as those of FIGS. 6A and 6B denote the same parts.

Figure 7A:
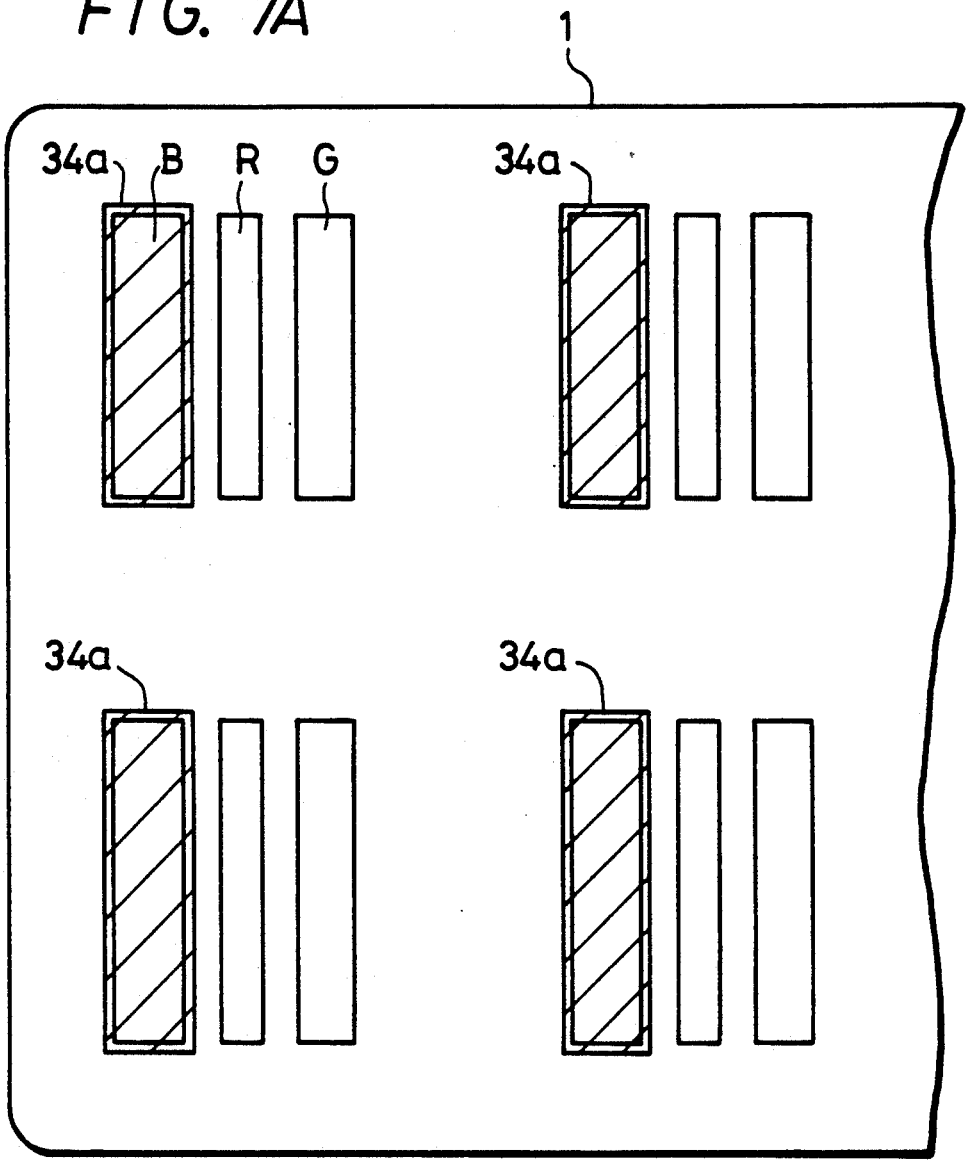
FIG. 7A is a fragmentary, front view of a fluorescent display cell used in a second embodiment (first modified example) of the present invention.
Figure 7B:
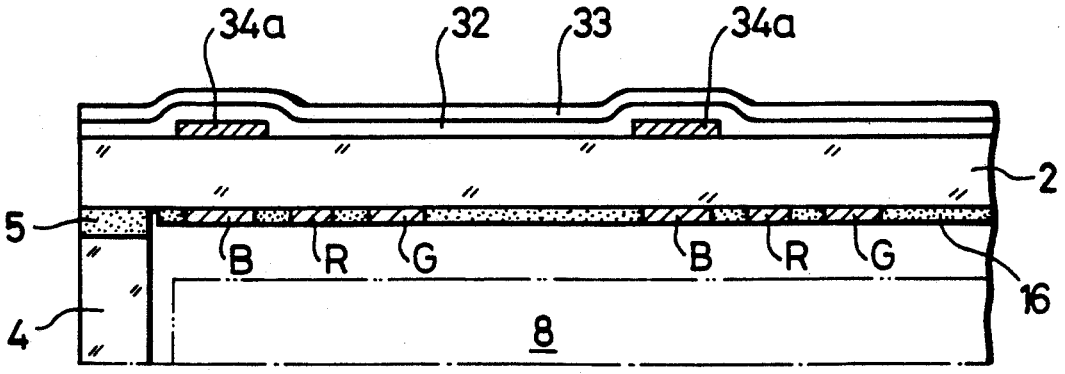
FIG. 7B is a fragmentary, diagrammatic view of a section of FIG. 7A.
Figure 8A:
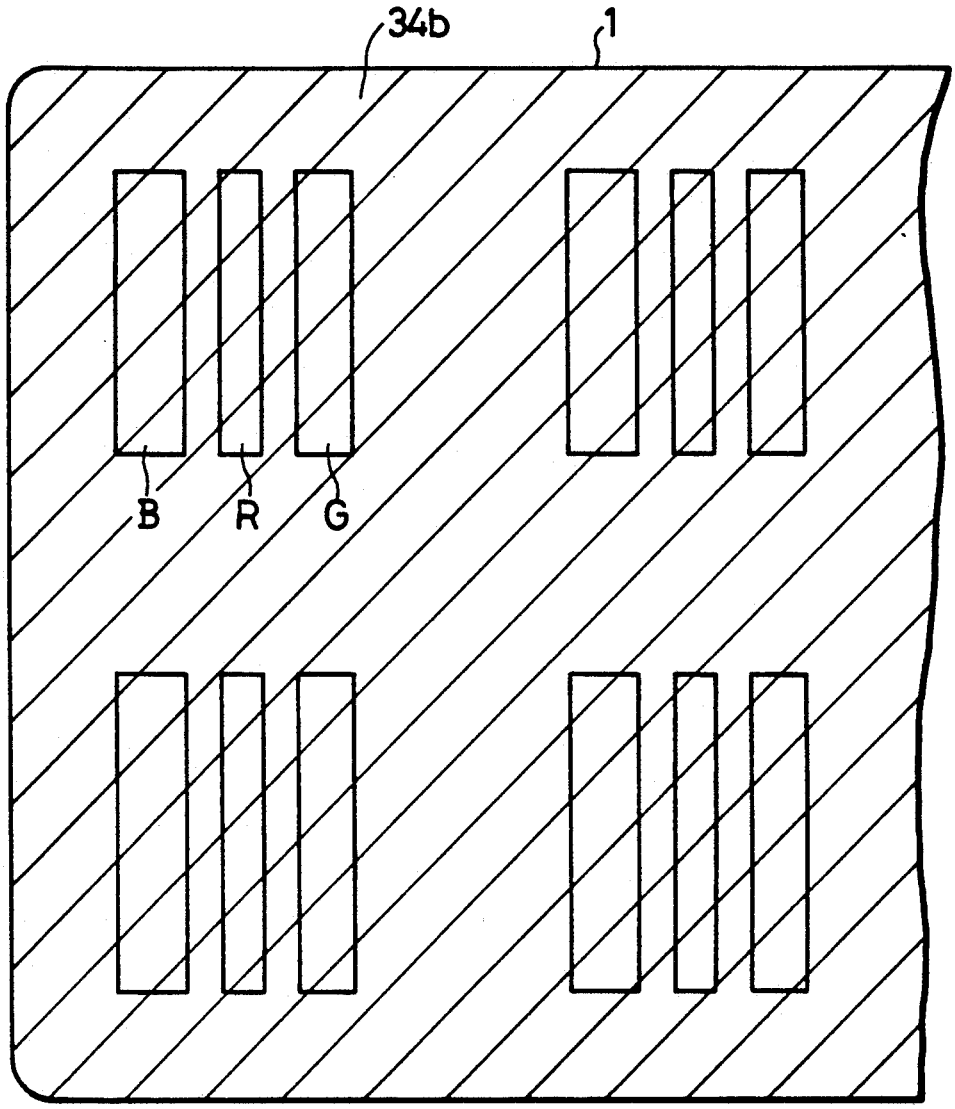
FIG. 8A is a fragmentary, front view of a fluorescent display cell used in a third embodiment (second modified example) of the present invention.
Figure 8B:
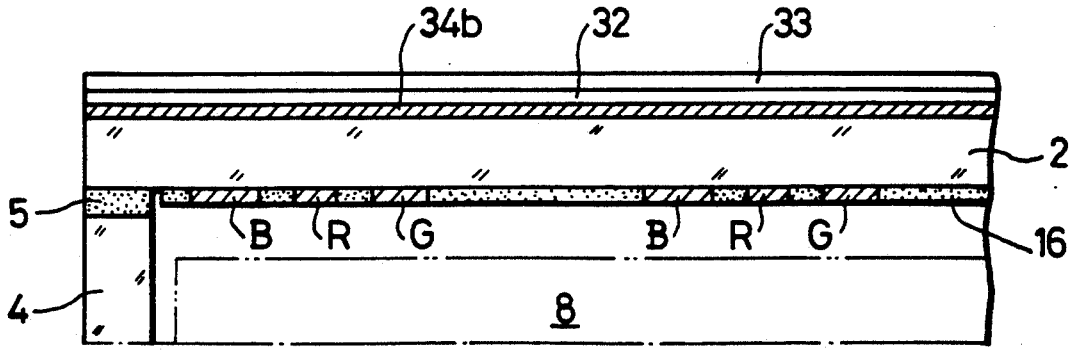
FIG. 8B is a fragmentary, diagrammatic view of a section of FIG. 8A.

FIGS. 7A and 7B illustrate a second embodiment (first modified example) of the invention in which a semitransparent film 34*a* which has an area which is substantially the same as the light-emission area of the segment is deposited on the outer surface of the front panel 2 at the position corresponding to the entire surface of a predetermined fluorescent segment (the blue fluorescent segment B if the color temperature is high, or the red or green fluorescent segment R or G if the color temperature is low).

Figure 9A:
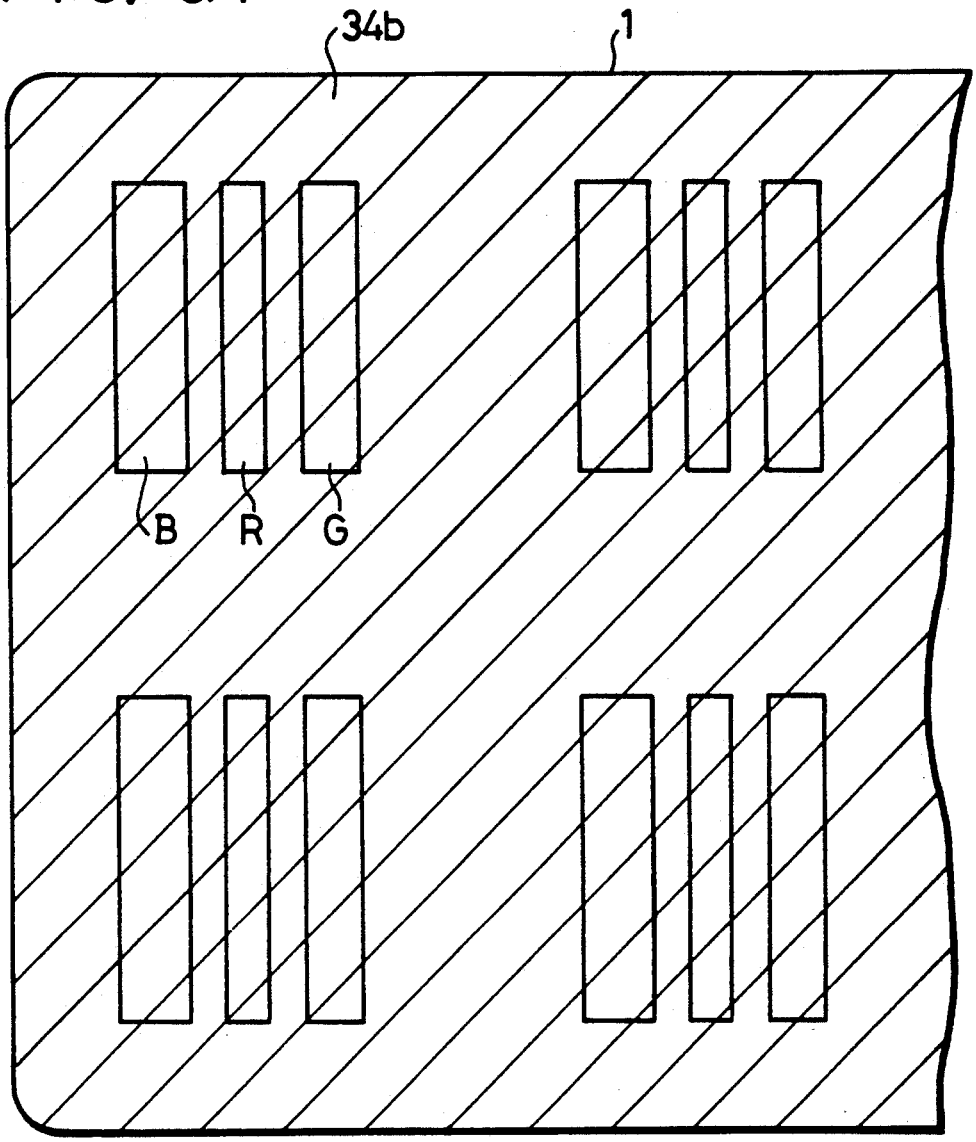
FIG. 9A is a fragmentary, front view of a fluorescent display cell used in a fourth embodiment (third modified example) of the present invention.
Figure 9B:
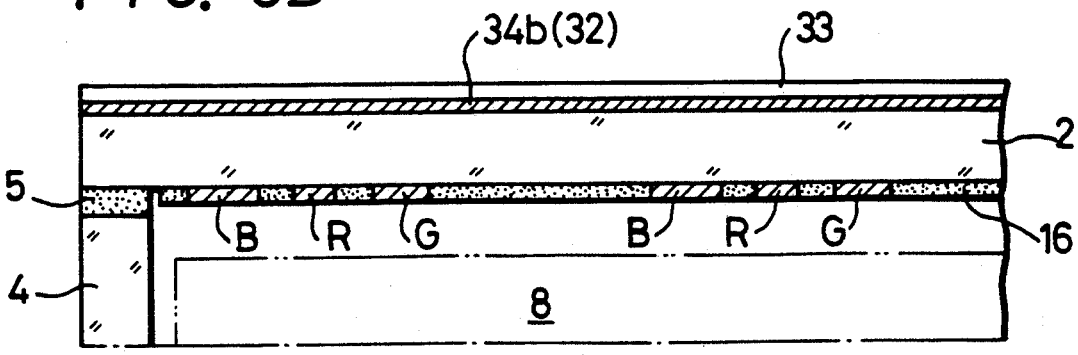
FIG. 9B is a fragmentary, diagrammatic view of a section of FIG. 9A.

FIGS. 8A, 8B and FIGS. 9A, 9B illustrate a third embodiment (second modified example) of the invention in which a semitransparent film 34*b* is deposited on the entire surface of the fluorescent display cell 1 when the color temperature is too high or too low. FIGS. 9A and 9B illustrate the case where the semitransparent film 34*b* serves as the antistatic film 32. The normal antistatic film is used in a fluorescent display cell which has a color temperature which falls within the standardized range.

Figure 10A:
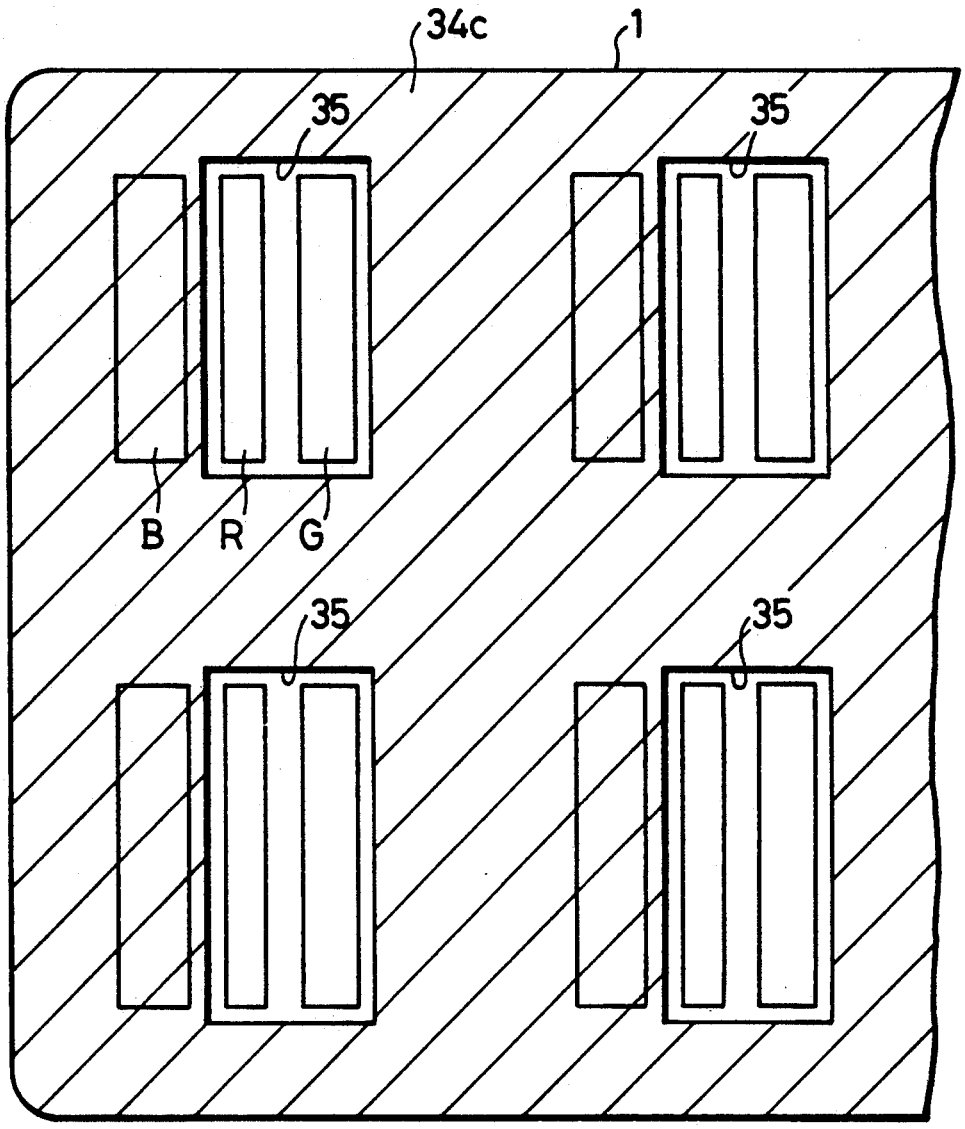
FIG. 10A is a fragmentary, front view of a fluorescent display cell used in a fifth embodiment (fourth modified example) of the present invention.
Figure 10B:
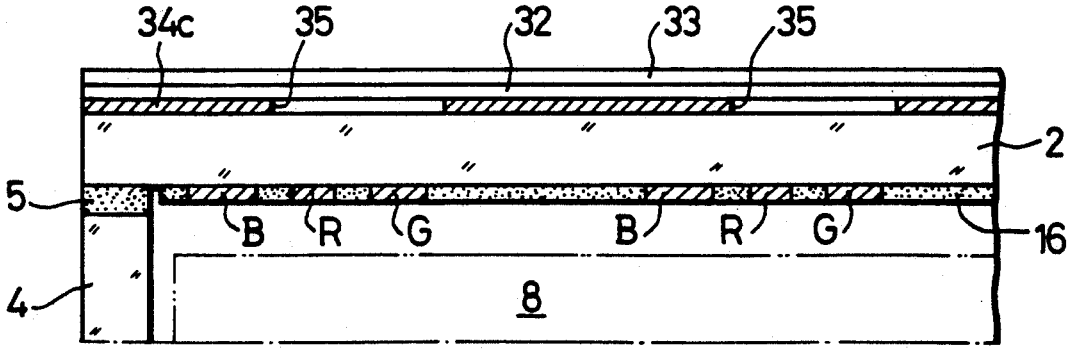
FIG. 10B is a fragmentary, diagrammatic view of a section of FIG. 10A.

FIGS. 10A and 10B illustrate a fourth embodiment (third modified example) of the present invention in which a film 34*c* which has a window portion 35 at the position corresponding to a fluorescent segment other than a predetermined fluorescent segment (the blue fluorescent segment B if the color temperature is high, or the red or green fluorescent segment R or G if the color temperature is low) is deposited on the outer surface of the front panel 2.

According to the second to fourth embodiments (first to third modified examples), similarly to the first embodiment the stripe-shaped shading material 31 is formed above the predetermined fluorescent segment by a printing-process, and the color temperature can be easily corrected so that the quality of the jumbo-size picture display device A can be improved and the image quality of the picture reproduced by such jumbo-size picture display device A can be improved. Also, the manufacturing costs of the jumbo-size picture display device A of the invention can be reduced.

While the present invention is applied to the fluorescent display cell 1 having an electron beam control mechanism 8 which is formed of the cathode K and first, second and third grids $G_1$, $G_2$ and $G_3$, each being formed as a flat plate shape in the aforementioned embodiments, the present invention can also be applied to other fluorescent display cells of high brightness which have an electron beam control mechanism which is formed of the cathode K and first and second grids $G_1$ and $G_2$.

Further, while the present invention is applied to the jumbo-size picture display device A in which a large number of fluorescent display cells 1, each having the electron beam control mechanisms 8 within the flat glass housing 6 are aligned in the X-Y matrix form, the present invention can also be applied to other jumbo-size picture display devices in which a number of cathode ray tubes, each being formed of panel and funnel portions and having incorporated therein an electron gun, are aligned. Furthermore, the present invention can be applied to a jumbo-size picture display device which is formed of a single display cell.

In addition, while in the illustrated example the fluorescent segments R, G and B are formed as stripe-shaped fluorescent segments, they may also be circular. In that case, the diameter of the shading material 31 in the embodiment of FIG. 6 is smaller than that of each of the fluorescent segments R, G and B.

As set out above, in the jumbo-size picture display device in which a number of red, green and blue fluorescent segments are aligned in the X-Y matrix form according to the present invention, the shading material for adjusting the color temperature is formed on the predetermined red, green and blue fluorescent segments, whereby the color temperature of the jumbo-size picture display device can be easily corrected. Therefore, the quality of the jumbo-size picture display device can be improved, the quality of the picture reproduced by the jumbo-size picture display device can be improved and the manufacturing costs of the jumbo-size picture display device can be reduced.

Having described preferred embodiments of the invention with reference to the accompanying drawings, it is to be understood that the invention is not limited to those precise embodiments and that various changes and modifications could be effected by one skilled in the art without departing from the spirit or scope of the novel concepts of the invention as defined in the appended claims.

Although the invention has been described with respect to preferred embodiments, it is not to be so limited as changes and modifications can be made which are within the full intended scope of the invention as defined by the appended claims.

We claims as our invention:

1. A display device comprising, a plurality of picture cells wherein said plurality of picture cells are aligned in an X-Y matrix form to form a display panel, a plurality of fluorescent trios, each being formed of red, green and blue fluorescent segments, aligned on the inner surface of the front panel of said picture cell, in which a shading material for controlling the white color temperature is formed on an outer surface of said front panel at a position corresponding to a predetermined fluorescent segment in order that, when all of the fluorescent trios are driven, the white color temperatures on the whole display surface will be uniform and wherein if the white color temperature is too high, said shading material is aligned with said blue fluorescent segments and if the white color temperature is too low, said shading material is aligned with said red or green fluorescent segments.

2. A display device according to claim 1, wherein said shading material for controlling the white color temperature is provided for all the fluorescent segments of the predetermined colors in a predetermined picture cell.

3. A display device according to claim 1, wherein said white color temperature falls within a range of 9300°±2000° Kelvin when said shading material has been applied.

4. A display device according to claim 1, wherein said shading material has a shape which corresponds to one of the fluorescent segments and has an area which is smaller than said one fluorescent segment.

5. A display device according to claim 4, wherein said shading material is attached to or is printed on the outer surface of said front panel at a position corresponding to said fluorescent segment.

6. A display device according to claim 4, wherein said shading material is a black material.

7. A display device according to claim 4, wherein said shading material is a white material.

8. A display device according to claim 4, wherein said shading material is rectangularly shaped.

9. A display device according to claim 4, wherein said shading material is circularly shaped.

10. A display device according to claim 1, wherein an antistatic film is formed over the entire outer surface of the front panel of each picture cell including said shading material.

11. A display device according to claim 1, wherein a dazzling-preventing film is formed over the entire outer surface of the front panel of each picture cell including said shading material.

12. A display device according to claim 1, wherein said picture cell is a fluorescent display cell.

13. A display device according to claim 1, wherein said picture cell is a cathode ray tube.

14. A display device according to claim 1, wherein said shading material is a semitransparent film which has a low optical transmissivity.

15. A display device according to claim 14, wherein said semitransparent film has substantially the same area as the light-emission area of one fluorescent segment.

16. A display device according to claim 14, wherein said transparent film is formed over the entire outer surface of the front panel of said picture cell.

17. A display device comprising, a plurality of picture cells wherein said plurality of picture cells are aligned in an X-Y matrix form to form a display panel, a plurality of fluorescent trios, each being formed of red, green and blue fluorescent segments, aligned on the inner surface of the front panel of said picture cell, in which a shading material for controlling the white color temperature is formed on an outer surface of said front panel at a position corresponding to a predetermined fluorescent segment in order that, when all of the fluorescent trios are driven, the white color temperatures on the whole display surface will be uniform and wherein said shading material is a semitransparent film which has a low optical transmissivity, wherein said semitransparent film is formed over the entire outer surface of the front panel of said picture cell, and wherein said semitransparent film has an aperture at a position corresponding to a fluorescent segment other than said predetermined fluorescent segment.

18. A method of forming a display device which has a uniform white color temperature comprising the steps of:

forming a plurality of picture cells in each of which is mounted a plurality of fluorescent trios, each being formed of red, green and blue fluorescent segments, aligned on the inner surface of the front panel of said picture cell, measuring the white color temperature of each of said plurality of picture cells, and applying shading material over said blue fluorescent segments of said picture cell if the measured white color temperature is higher than a first predetermined value and applying shading material over said red or green fluorescent segments if said white color temperature is lower than a second predetermined value.

19. A display device, comprising a) a plurality of picture cells in each of which are mounted a plurality of fluorescent trios, each being formed of red, green and blue fluorescent segments, and which are aligned on an inner surface of a front panel of each picture cell at a predetermined alignment pitch; and b) a shading material for controlling the color temperature of the white color formed on an outer surface of said front panel at a position corresponding to a predetermined fluorescent segment so that when all of the fluorescent trios are driven, the color temperature of the white color on the entire display surface will be uniform.

* * * * *